US005307123A

United States Patent [19]

Aimoto

[11] Patent Number: 5,307,123

[45] Date of Patent: Apr. 26, 1994

[54] DEVELOPING UNIT HAVING CAPABILITY OF PREVENTING DEVELOPING POWDER FROM BEING JAMMED AROUND EXHAUST OUTLET

[75] Inventor: Toyoka Aimoto, Nara, Japan

[73] Assignee: Sharp Kubushiki Kaisha, Osaka, Japan

[21] Appl. No.: 918,498

[22] Filed: Jul. 22, 1992

[30] Foreign Application Priority Data

Dec. 2, 1991 [JP] Japan ..... 3-317981

[51] Int. Cl.[5] ..... G03G 15/08

[52] U.S. Cl. ..... 355/245; 118/653

[58] Field of Search ..... 355/253, 255, 259, 245; 118/654, 657, 653

[56] References Cited

U.S. PATENT DOCUMENTS 4,451,133 5/1984 Kopp et al. .

4,891,671 1/1990 Iwamasa ..... 355/245

5,025,289 6/1991 Guslits et al. ..... 355/253

FOREIGN PATENT DOCUMENTS 60-153066 8/1985 Japan .

*Primary Examiner*—R. L. Moses

*Attorney, Agent, or Firm*—David G. Conlin; George W. Neuner

[57] ABSTRACT

A developing unit includes a developing bath, rollers used for developing an image, and a rotary body for exhausting developing powder out of the developing bath through an exhaust outlet. The rollers and the rotary body are rotatably fitted to the developing bath. When developing an image, the rotary body is rotated in an opposite direction to the rotating direction when exhausting the developing powder.

11 Claims, 4 Drawing Sheets

DEVELOPING UNIT HAVING CAPABILITY OF PREVENTING DEVELOPING POWDER FROM BEING JAMMED AROUND EXHAUST OUTLET

BACKGROUND OF THE INVENTION

1. Field of the Invention

The present invention relates to a developing unit provided in an image forming apparatus of an electronic photography type and more particularly to a control unit for rotary components used for exhausting developing powder out of a developing bath in the developing unit.

2. Description of the Related Art

The inventors of the present application know a mechanism for adjustably feeding developing powder to a developing unit. The known mechanism includes a toner density sensor and is constructed so that when the sensor senses the absence of developing powder being recovered in the developing unit, the rotary system for recovering the developing powder is deactivated and the feeding unit is activated in response to the sensing signal, for feeding a necessary amount of new developing powder into the developing unit. This mechanism has been disclosed in Japanese Patent Lying Open No. 61-39061.

In the known mechanism, the rotary system such as rollers and screws provided in the developing unit is driven at a constant speed needed in a developing process. The same speed has been maintained in feeding new developing powder, exhausting waste developing powder, and developing an image.

As such, it may take a long time to exchange the developing powder. Since no work can be done for an image forming apparatus during the exchanging time, the long wasteful time is consumed in exchanging the developing powder.

As a prior art for solving the foregoing disadvantage, the applicant of the present application has proposed in the Japanese Patent Application No. 3-284558 that the rotary speed of the rollers and the screw given in exhausting the developing powder is faster than the speed given in developing an image.

In this prior art, the screw is constantly driven. Hence, the developing powder is forced to constantly travel toward an exhaust outlet, so that the developing powder is jammed around the exhaust outlet and causes the shaft of the screw to be locked with its bearing.

SUMMARY OF THE INVENTION

It is an object of the present invention to provide a developing unit which has a capability of preventing the developing powder from being jammed around an exhaust outlet when developing an image.

A developing unit according to the present invention includes a developing bath for containing a developing powder, a stirring roller disposed in the bath for development, a rotary body disposed in the bath for exhausting the developing powder out of the developing bath from an exhaust outlet, a unit for driving the rotary body to rotate in a case of developing an image in an opposite direction to that in a case of exhausting the developing powder.

Preferably, the developing unit further comprises a unit for controlling the driving unit so that a speed of the rotary body in the case of developing an image is slower than that in the case of exhausting the developing powder. The rotary body may be controlled to rotate intermittently for a predetermined time or in a predetermined number of turns.

In operation, when developing an image, the roller are rotated and the rotary body is rotated at a slower speed than a speed given when exhausting the developing powder and in an opposite to the rotation of the rollers. The developing powder is carried in an opposite direction to the exhaust outlet by virtue of the rotary body and finally reaches the side wall of the developing bath. Then, the developing powder is pressed upward and is stirred by the stirring roller.

As such, the developing powder is not concentrated on the exhaust outlet while developing an image, so that the developing powder is not jammed around the outlet. Further, by rotating the rotary body intermittently or at a slower speed than the speed given in exhausting the developing powder, the carrying force of the developing powder toward the shaft of the rotary body is made lower. This makes it possible to prevent the developing powder from being locally shifted, thereby enhancing the stirring performance.

Further objects and advantages of the present invention will be apparent from the following description of the preferred embodiments of the invention as illustrated in the accompanying drawings.

DESCRIPTION OF THE PREFERRED EMBODIMENTS

Figure 1:
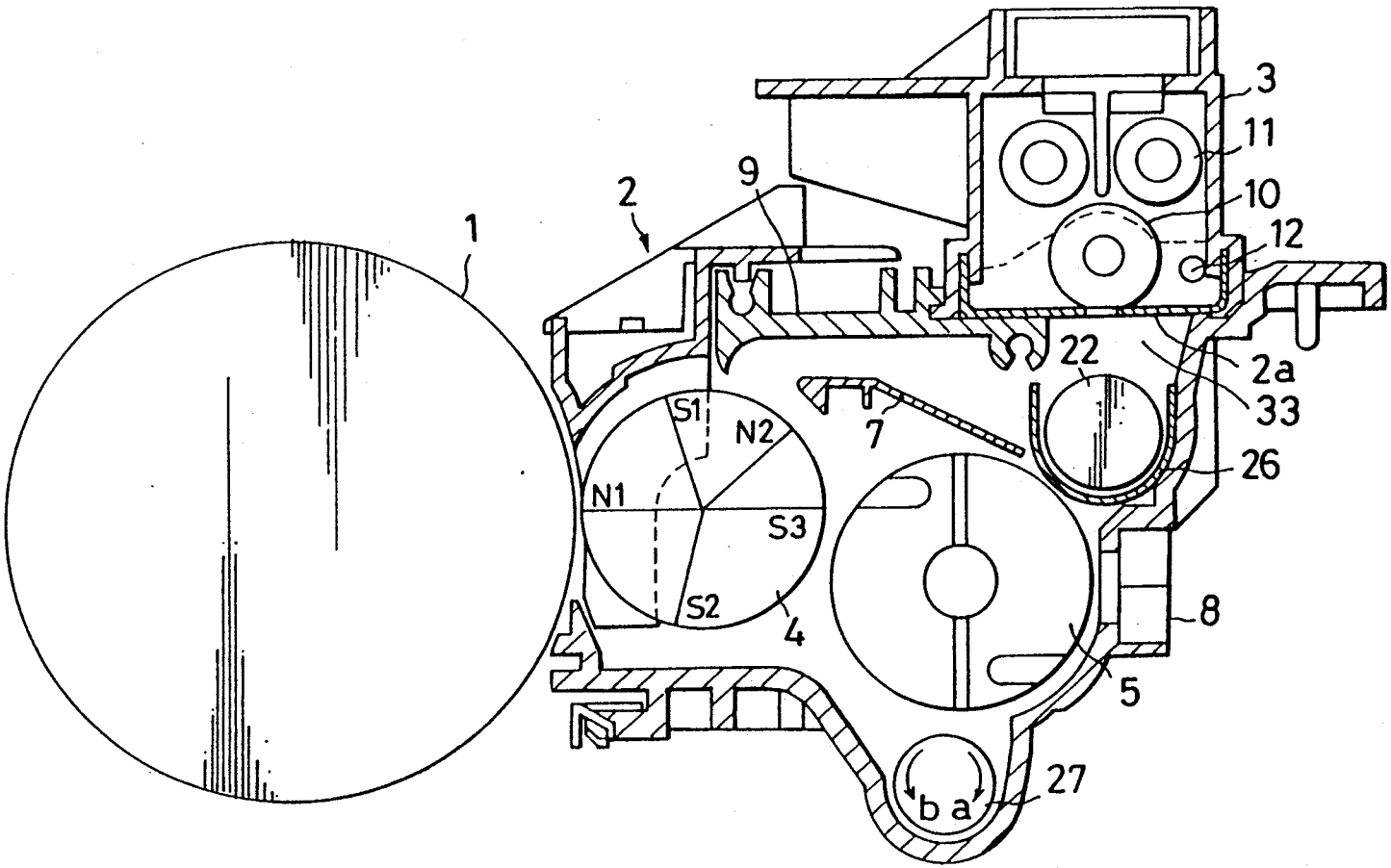
FIG. 1 is a section view showing a developing unit according to a first embodiment of the present invention.

The description will be directed to a developing unit according to a first embodiment of the present invention as referring to the drawings.

FIG. 1 is a sectional view showing the developing unit. As shown, 1 denotes a photosensitive drum. 2 denotes a developing bath. 3 denotes a toner hopper. 4 denotes a magnet roller. 5 denotes a stirring roller. 7 denotes a flow plate. 8 denotes a toner density sensor. 9 denotes a doctor. 10 denotes a toner feeding roller. 11 denotes a toner carrying screw.

Figure 2:
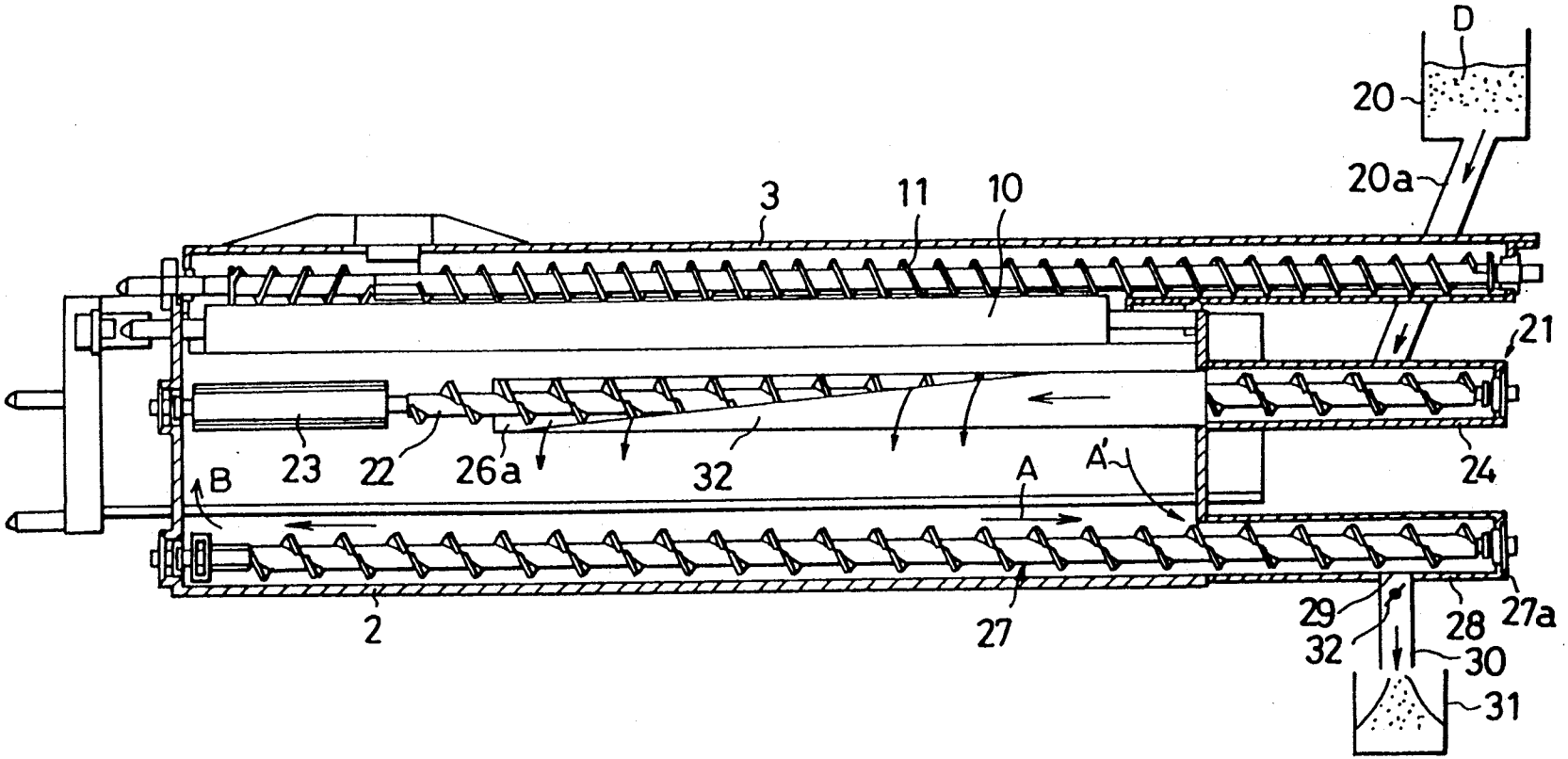
FIG. 2 is a side sectional view showing the developing unit shown in FIG. 1.

Turning to FIG. 2 showing the side of the developing unit, 20 denotes a feeding bath 20 for feeding developing powder D into the developing bath. 21 denotes a carrying mechanism for carrying the developing powder D in the developing bath 2. The carrying mechanism 21 comprises a carrying screw 22 and a stirring member 23. The carrying screw 22 serves to carry the developing powder D from one side to the other side of the developing bath 2 along a longitudinal length. The stirring member 23 serves to stir the developing powder D circumferentially at the other side.

Figure 3:
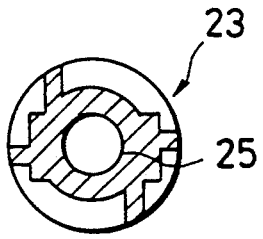
FIG. 3 is a section view showing an agitator included in the developing unit.

As shown in FIG. 1, the carrying mechanism is located immediately below an opening 2*a* of the developing bath 2 and in an obliquely upward of the stirring roller 5. As shown in FIG. 2, the carrying screw 22 is fitted inside of a cylinder 24 projected on the inside of the developing bath 2. The carrying screw 22 is constructed to have a rotary shaft 25 and a spiral plate fitted on the rotary shaft 25. The stirring member 23 is composed of an agitator whose sectional form is as shown in FIG. 3. The stirring member 23 is mounted on the other side of the rotary shaft 25. Both ends of the rotary shaft 25 are rotatably supported by the developing bath 2 and the cylinder 24, respectively.

The developing powder D being fed from the feeding bath 20 is gradually carried from the powder entry side of the developing bath 2 (as viewed in the right hand of FIG. 2) to the inner side of the bath, whereby the powder entry side means a side of the bath near the feeding bath 20 in the longitudinal direction of the developing bath. Since all the developing powder D is not carried, however, more of the developing powder D is left around the entry part than at the remaining part. That is, the distribution of the developing powder in the developing bath 2 is formed like a mountain whose tip is shifted to the entry side. Hence, the density of the developing powder D is higher around the entry part and gradually becomes lower toward the opposite side, that is, the inner side.

The irregular density of the developing powder D may give rise to an uneven-density image. To make the density even, it is necessary to stir the developing powder D again. Only the carrying screw 22, however, cannot achieve the efficient re-stirring operation.

To achieve the efficient re-stirring, there is a carrying path for the toner between the carrying screw 22 and a conduit pipe 26 as shown in FIG. 1. The conduit pipe 26 has an opening 26*a* (see FIG. 2) progressively increasing from the powder entry side to the opposite side of the developing bath. The conduit pipe 26 is formed around the carrying screw 22 like a U character in a manner that the opening 26*a* may be directed upward. The wall of the carrying path 26 opposite to the rotating direction of the carrying screw 22 is made gradually lower from the entry side to the opposite side.

Further, below the stirring roller 5, there is located an exhausting screw 27 for exhausting the waste developing powder D from the developing bath 2. Like the carrying mechanism 21, the exhausting screw 27 is fitted into a cylinder 28 projected on the inside of the developing bath 2 at the exhaust side. Both ends of the exhausting screw 27 are rotatably supported on the developing bath 2 and the cylinder 28, respectively.

The feeding bath 20 is connected to the cylinder 24 so that a shutter (not shown) is provided between the cylinder 24 and the feeding bath 20. The bath 20 may selectively communicate with the cylinder 24 if necessary through the effect of a shutter.

The cylinder 28 is provided with an exhaust outlet 29 formed thereon. The exhaust outlet 29 is connected to a waste vessel 31 through an exhaust pipe 30. A shutter 32 is rotatably fitted inside of the exhaust pipe 30. The shutter 32 is controlled to close the exhaust outlet 29 when developing an image and open it when exhausting the waste developing powder.

The waste vessel 31 is provided on the same side as the feeding bath 20 in the developing unit and is allowed to be easily removed from the main body of the image forming apparatus.

The magnet roller 4, the stirring roller 5, the carrying screw 22 and the exhaust screw 27 are rotated by driving units 33, 34 such as respective motors through transmissions and gears. The driving units are located on the opposite side of the developing unit in the image forming apparatus.

A control unit 35 having a microcomputer is provided on the main body of the image forming apparatus and for controlling the driving units 33, 34.

Figure 4:
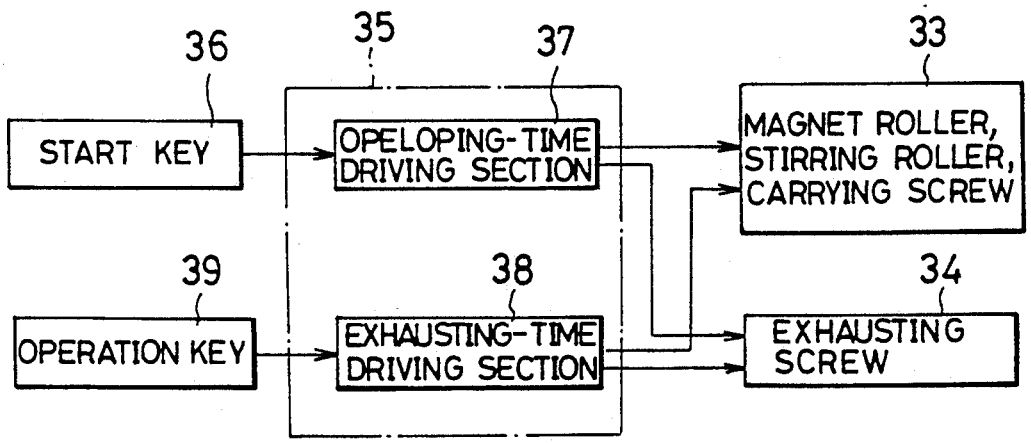
FIG. 4 is a block diagram showing a control unit included in the developing unit.

As shown in FIG. 4, the control unit 35 is arranged to have a developing-time driving section 37 and an exhausting-time driving section 38. The developing-time driving section 37 serves to drive the rollers 4, 5 and the carrying screw 22 and drive the exhausting screw 27 in an opposite direction to that when exhausting the developing powder with a start key 36 being turned on. The exhausting-time driving section 38 serves to drive the rollers 4, 5 and the carrying screw 22 and drive the exhausting screw 27 at a faster speed than the speed given when developing an image when exhausting the waste developing powder D.

The exhausting-time driving section 38 is activated by turning on an operation key 39 for exchanging the developing powder D and has a function of operating the shutter 32 of the exhaust outlet 29.

In the foregoing construction, in a case that the waste developing powder D is exhausted and the new developing powder D is fed, the shutter 32 is opened so that the exhausting screw 27 may be rotated in the a direction as shown in FIG. 1 by means of the driving unit 34. As a result, the waste developing powder D in the developing bath 2 is allowed to travel in the A and A' direction (see FIG. 2) by means of the exhausting screw 27 and then drop from the exhaust outlet 20 of the cylinder 28, through which the waste developing powder D is guided to the waste vessel 31.

Next, to feed the new developing powder D, the shutter 32 for the exhaust outlet is closed and the shutter for the feeding bath is opened so that the new developing powder D flows from the feeding bath 20 into the carrying cylinder 24.

By driving the rollers 4, 5 and the carrying screw 22 at a rotary speed Vb, as shown in FIG. 2, the developing powder is allowed to travel from the entry side to the inner side by means of the carrying screw 22.

The developing powder D overflown out of the opening 26*a* is progressively increased from the entry side to the inner side. Hence, the distribution of the developing powder D is not shifted toward the entry side. It means that no special stirring operation is required for feeding the developing powder uniformly. Then, the stirring roller 5 serves to charge the developing powder D in the developing bath 2.

The carrying screw 22 is used for carrying the developing powder D from the entry side to the inner side and provides excellent carrying efficiency. If the carrying screw 22 is extended to the tip of the rotary shaft 25 results in constantly moving the developing powder D in the B direction, thereby making the height of the developing powder D in the developing bath 2 irregular, which makes the toner density variable. Hence, the resulting copying image may be degraded.

To prevent the disadvantageous phenomenon, the stirring member 23 is provided on the shaft 25 at the opposite side of the entry side as shown in FIG. 2. This stirring member 23 provides no capability of carrying the developing powder in the longitudinal direction but a more excellent capability of stirring the developing powder radially than the carrying screw 22. Hence, the developing powder D is carried toward the inner side by the carrying screw 22 and is diffused radially by means of the stirring member 23 to keep the density of the developing powder D uniform in the developing bath 2.

When developing an image, the rollers 4, 5 and the carrying screw 22 are rotated. The exhausting screw 27 is also rotated at a rotary speed given when exhausting the developing powder and toward an arrow b as shown in FIG. 1.

The developing powder is carried in the B direction, that is, an opposite direction to the exhaust outlet 29 by virtue of the exhausting screw 27. Then, the developing powder reaches the side wall of the developing bath 2, where the developing powder is pushed upward and is stirred by the stirring roller 5.

Therefore, the developing powder is not concentrated inside of the cylinder 28 while developing an image. Hence, no developing powder is jammed at the exhaust outlet 29 and the shaft of the screw 27 is not locked with its bearing 27*a*.

The rotary speed of the exhausting screw 27 is slower when exhausting the waste developing powder than when developing an image. Hence, the carrying force of the developing powder toward the shaft of the screw 27 is made lower so that the developing powder may be prevented from being locally shifted. This makes contribution to enhancing a stirring capability, resulting in preventing the degraded quality of the copied image due to lack of a stirring work of the developing powder.

Figure 5:
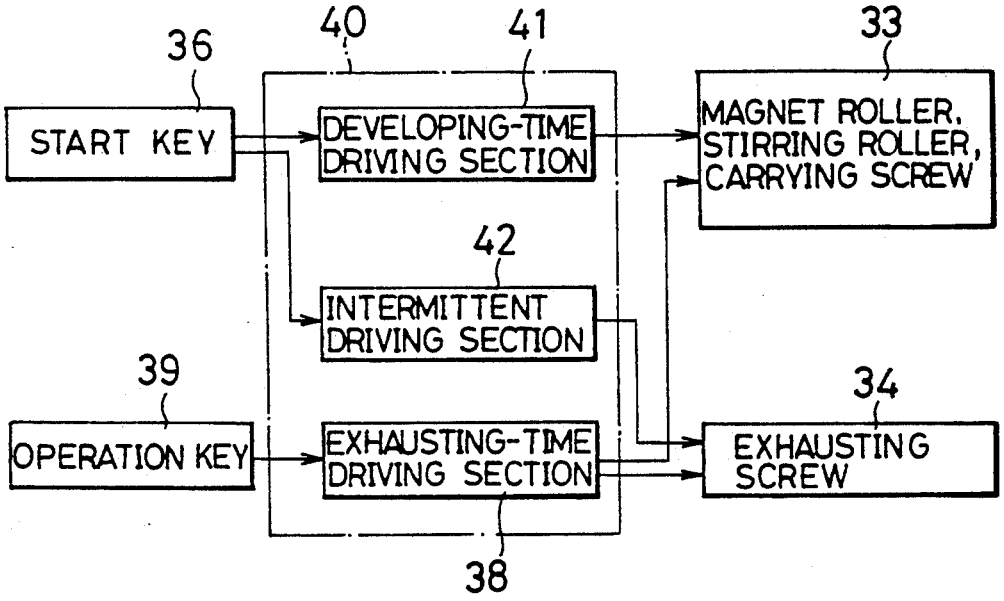
FIG. 5 is a block diagram showing a developing unit according to a second embodiment of the present invention.

In turn, the description will be directed to a developing unit according to a second embodiment of the invention as referring to FIG. 5.

The construction and the operation of this embodiment is substantially same as those of the first embodiment except the control unit. Hereafter, therefore, the description is focused on the control unit.

As shown in FIG. 5, the control unit 40 is arranged to have a developing-time driving section 41 and an intermittent driving section 42. The developing-time driving section 41 serves to drive the rollers 4, 5 and the carrying screw 22 when developing an image. The intermittent driving section 42 serves to drive the exhausting screw 27 on a predetermined timing by a predetermined amount when developing an image. The rotating direction is opposite to that done when exhausting the developing powder.

The intermittent driving section 42 provides a function of driving the exhausting screw 27 several turns or for some minutes and stopping it if a power-on of the image forming apparatus, copying a predetermined number of sheets, rotating the rollers, or copying the predetermined number of one image is sensed.

By driving the exhausting screw 27 under the control of the intermittent driving section 42, it is possible to obtain the same effect as the case where the exhausting screw 27 is driven at a slower speed when developing an image according to the first embodiment.

In addition, the rotary body is not limited to the screw.

Many widely different embodiments of the present invention may be constructed without departing from the spirit and scope of the present invention. It should be understood that the present invention is not limited to the specific embodiments described in the specification, except as defined in the appended claims.

What is claimed is:

1. A developing device for use in an image forming apparatus, the device comprising:

a developing bath for containing a developing powder;

a stirring roller disposed in said developing bath for development;

a rotary body disposed in said developing bath for exhausting the developing powder out of said developing bath to an exhaust outlet; and means for driving said rotary body to rotate in one direction for conveying the developing powder away from the exhaust outlet in the case of developing an image and in an opposite direction for exhausting the developing powder to prevent the jamming of the developing powder at the exhaust outlet upon the development.

2. A developing unit according to claim 1, wherein said unit further comprises means for controlling said driving means so that a speed of said rotary body in the case of developing an image is slower than that in the case of exhausting the developing powder.

3. A developing unit according to claim 1, wherein said unit further comprises means for controlling said driving means so that said rotary body rotates intermittently for a predetermined time.

4. A developing unit according to claim 3, wherein said unit further comprises means for controlling said driving means so that said rotary body rotates intermittently in a predetermined number of turns.

5. A developing device according to claim 3, wherein said controlling means are enabled upon a power-on of the image forming apparatus, copying operations of the image forming apparatus, and a rotation of any one roller disposed in the developing bath.

6. A developing device according to claim 4, wherein said controlling means are enabled upon a power-on of the image forming apparatus, copying operations of the image forming apparatus, and a rotation of any one roller disposed in the developing bath.

7. A developing device for use in an image forming apparatus, the device comprising:

a developing bath for containing a developing powder;

a stirring roller disposed in said developing bath for development;

a rotary body disposed in said developing bath for exhausting the developing powder out of said developing bath to an exhaust outlet;

means for driving said rotary body to rotate in one direction for developing an image and in an opposite direction for exhausting the developing powder; and means for controlling said driving means so that a speed of said rotary body in the case of developing an image is slower than that in the case of exhausting the developing powder.

8. A developing device for use in an image forming apparatus, the device comprising:

a developing bath for containing a developing powder;

a stirring roller disposed in said developing bath for development;

a rotary body disposed in said developing bath for exhausting the developing powder out of said developing bath to an exhaust outlet;

means for driving said rotary body to rotate in one direction for developing an image and in an opposite direction for exhausting the developing powder; and means for controlling said driving means so that said rotary body rotates intermittently for a predetermined time.

9. A developing device according to claim 8, wherein said controlling means comprises means for controlling said driving means so that said rotary body rotates intermittently in a predetermined number of turns.

10. A developing device according to claim 8, wherein said controlling means are enabled upon a power-on of the image forming apparatus, copying operations of the image forming apparatus, and a rotation of any one roller disposed in the developing bath.

11. A developing device according to claim 9, wherein said controlling means are enabled upon a power-on of the image forming apparatus, copying operations of the image forming apparatus, and a rotation of any one roller disposed in the developing bath.

* * * * *